US007278270B2

(12) United States Patent
Culp et al.

(10) Patent No.: US 7,278,270 B2
(45) Date of Patent: Oct. 9, 2007

(54) INSULATED CONTAINER WITH THERMOELECTRIC UNIT

(75) Inventors: Yiyun Culp, Wichita, KS (US); Mark Charles Kitchens, Athens, TX (US); John Chiu, Taipei (TW); Regis Marie-Jean Wandres, Athens, TX (US)

(73) Assignee: The Coleman Company, Inc., Wichita, KS (US)

( * ) Notice: Subject to any disclaimer, the term of this patent is extended or adjusted under 35 U.S.C. 154(b) by 181 days.

(21) Appl. No.: 11/169,348

(22) Filed: Jun. 29, 2005

(65) Prior Publication Data

US 2006/0000221 A1 Jan. 5, 2006

Related U.S. Application Data

(60) Provisional application No. 60/584,580, filed on Jul. 1, 2004.

(51) Int. Cl.
*F25B 21/02* (2006.01)
*F28D 5/00* (2006.01)
*H01L 35/28* (2006.01)

(52) U.S. Cl. ..... 62/3.6; 62/314; 136/203

(58) Field of Classification Search ..... 62/3.2, 62/3.3, 3.6, 3.7, 186, 314, 414, 419, 457.9; 136/203

See application file for complete search history.

(56) References Cited

U.S. PATENT DOCUMENTS 5,315,830 A * 5/1994 Doke et al. ..... 62/3.2
5,367,879 A * 11/1994 Doke et al. ..... 62/3.6
5,501,076 A * 3/1996 Sharp et al. ..... 62/3.6
5,605,047 A * 2/1997 Park et al. ..... 62/3.6
5,884,486 A * 3/1999 Hughes et al. ..... 62/3.4
6,003,319 A * 12/1999 Gilley et al. ..... 62/3.7
6,021,642 A * 2/2000 Guinn ..... 62/3.6
6,073,789 A 6/2000 Lundblade
6,282,906 B1 * 9/2001 Cauchy ..... 62/3.3
6,298,668 B1 * 10/2001 Lo ..... 62/3.2
6,484,512 B1 * 11/2002 Anderson et al. ..... 62/3.2
6,530,231 B1 * 3/2003 Nagy et al. ..... 62/3.2
6,612,116 B2 * 9/2003 Fu et al. ..... 62/3.6
6,715,299 B2 * 4/2004 Kim et al. ..... 62/3.6
6,798,659 B2 * 9/2004 Chen ..... 361/697
6,895,762 B1 * 5/2005 Lin ..... 62/3.3

FOREIGN PATENT DOCUMENTS

GB 2267338 A * 12/1993

* cited by examiner

*Primary Examiner*—Mohammad M. Ali
(74) *Attorney, Agent, or Firm*—Leydig, Voit & Mayer, Ltd.

(57) ABSTRACT

A thermoelectric unit for a thermoelectric insulated container. The thermoelectric unit is configured to be inserted in a small opening in the insulated container. A cold side heat sink is mounted on the portion of the thermoelectric unit that extends inside of the insulated container, and a hot side heat sink is mounted on a portion of the thermoelectric unit that extends outside. The thermoelectric unit is arranged so that a thermoelectric module for the thermoelectric unit, the cold side heat sink, and the hot side heat sink are aligned linearly. A hot side fan and motor unit is mounted on the outside of the hot side heat sink and a cold side fan and motor unit is mounted on the outside of the cold side heat sink. The hot and cold side fan and motor units may also be mounted linearly with the hot and cold side heat sinks.

11 Claims, 3 Drawing Sheets

INSULATED CONTAINER WITH THERMOELECTRIC UNIT

REFERENCE TO RELATED APPLICATION

This application claims the benefit of U.S. Provisional Application No. 60/584,580, filed Jul. 1, 2004, and incorporated herein by reference.

TECHNICAL FIELD OF THE INVENTION

The present invention generally relates to insulated containers, and more specifically relates to insulated containers having solid state heat pumps such as thermoelectric modules.

BACKGROUND OF THE INVENTION

Insulated containers, also called "coolers," are prevalent in contemporary life. The insulated containers are often used for picnics or for outdoor activities such as camping or sporting events. In addition, insulated containers are becoming more prevalent in the medical industry, where they are used to move transplant organs and other articles that need to remain cold during transport. Also, the need to transport commercial goods such as perishable food, drink, medicine, and environmental samples is becoming more important.

One downside to current insulated containers is the limited length of time that an insulated container can keep something cold. For example, if ice is used in the insulated container, the ice will often melt because the cooler cannot maintain the colder interior temperatures needed to prevent melting of the ice. Frozen ice packs do not last much longer. Traditional vapor cycle systems, while efficient, are quite large and heavy. Most of these systems require a 110-volt outlet to operate. A few 12 volt or 24 volt systems are available today; however, these systems are also large and heavy. The vapor cycle 12 and 24-volt systems also may have problems with vibrations during transportation. In addition, there exists absorption and adsorption refrigerators, but these fail if enough vibrations exist and improper orientation may also cause the units to fail. Like the vapor cycle refrigerators, these cooler systems are heavy, and must use ammonia in order to freeze.

One solution that has been used for providing insulated containers that can maintain cold temperatures for long periods of time is to incorporate solid state heat pumps such as thermoelectric modules in the insulated containers. Such devices are typically provided power through a DC power input such as a car cigarette lighter adapter.

Many of the newer insulated container refrigeration units utilize a thermoelectric module. Thermoelectric modules are solid state heat pumps based on the Peltier Effect, by which DC current applied across two dissimilar materials causes a temperature differential. A thermoelectric cooler utilizes a thermoelectric module that is capable of providing this temperature differential.

The typical thermoelectric module is manufactured using two thin ceramic wafers with a series of proton (P) and neutron (N) doped bismuth-telluride semiconductor materials sandwiched between them. The ceramic material on both sides of the thermoelectric adds rigidity and electrical insulation. The N type material has an excess of electrons, while the P type material has a deficit of electrons. One P and one N make up a couple. The thermoelectric couples in a thermoelectric module are connected electrically in series and thermally in parallel. A thermoelectric module can contain one to several hundred couples.

As the electrons move from the P type material to the N type material through an electrical connector, the electrons jump to a higher energy state, absorbing thermal energy and providing a cold side of the thermoelectric module. Continuing through the lattice of material, the electrons flow from the N type material to the P type material through an electrical connector, dropping to a lower energy state and releasing energy as heat to the heat sink, providing a hot side of the thermoelectric module.

The fact that a thermoelectric module includes both a hot side and a cold side permits a thermoelectric module to be used to heat or to cool. For insulated containers in which cooling is to be provided, the cold side is used to remove heat from the insulated container.

The fact that a thermoelectric module has a hot side and a cold side presents problems, however. For a thermoelectric insulated container to operate efficiently, the hot side is typically arranged on the outside of the insulated container. However, the cold side needs to be in communication with the interior of the insulated container so that it may remove heat from the interior of the insulated container. Thus, the insulated container must be arranged to effectively allow the hot side and cold side to be mounted in the proper locations. This arrangement usually requires at least a portion of the insulation of a container be removed for the purpose of installing the thermoelectric module and its associated heat transfer components. Removing some of the insulation of the cooler can cause an associated heat loss, which can greatly affect performance of a thermoelectric insulated container.

Another problem with thermoelectric insulated containers is that their assembly is labor intensive. This presents a problem in that labor is expensive. Moreover, because insulated containers are often too large to ship economically, labor for a thermoelectric insulated container often may not be performed at more cost efficient labor areas, such as overseas.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, a thermoelectric unit is provided for a thermoelectric insulated container. The thermoelectric unit is arranged and configured to be inserted in a small opening in the insulated container. A cold side heat sink is mounted on the portion of the thermoelectric unit that extends inside of the insulated container, and a hot side heat sink is mounted on a portion of the thermoelectric unit that extends outside the insulated container.

In accordance with an embodiment, the thermoelectric unit is arranged so that a thermoelectric module for the thermoelectric unit, the cold side heat sink, and the hot side heat sink are aligned linearly. A hot side fan and motor unit is mounted on the outside of the hot side heat sink and a cold side fan and motor unit is mounted on the outside of the cold side heat sink. In accordance with an embodiment, the hot and cold side fan and motor unit units are also mounted linearly with the hot and cold side heat sinks and the thermoelectric module.

Linearly aligning the components of the thermoelectric unit minimizes the overall size of the thermoelectric unit and thus reduces freight costs. It also permits a single, smaller opening in the insulated cooler to be provided for installation of the thermoelectric unit. The smaller opening reduces heat loss, increasing efficiency of the thermoelectric insulated container. The components of the thermoelectric unit may be arranged in a manner other than linearly, but providing the components in another arrangement may increase the associated freight costs and decrease the efficiency of the thermoelectric insulated cooler.

In accordance with an embodiment, a thermally conductive block is mounted on the cold side of the thermoelectric module to provide a spacer to permit the cold side heat sink to be mounted on the interior of the insulated container and the hot side heat sink to be mounted on the exterior of the insulated container, as well as to transfer heat from the inside of the cooler to the outside of the cooler. In accordance with an embodiment, insulation is blown around this thermally conductive block to minimize heat loss through the thermoelectric unit.

The thermoelectric unit of the present invention may also include one or more of the following: electrical wires and connectors for the hot and cold side fan and motor unit units and the thermoelectric module, thermal switches, holders for the thermoelectric module and thermal switches, fasteners for joining components, foam insulations, and fan covers for the hot or cold side fans. The entire thermoelectric unit may be assembled in one location and may be connected to the insulated container in another location, providing an opportunity for the thermoelectric unit to be assembled in a lower-cost labor market (e.g., overseas) and to be shipped to a local facility for assembly with the insulated container. This feature significantly reduces the need for local labor while maximizing the efficiency of the thermoelectric coolers.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to, obscure the embodiment being described.

Figure 1:
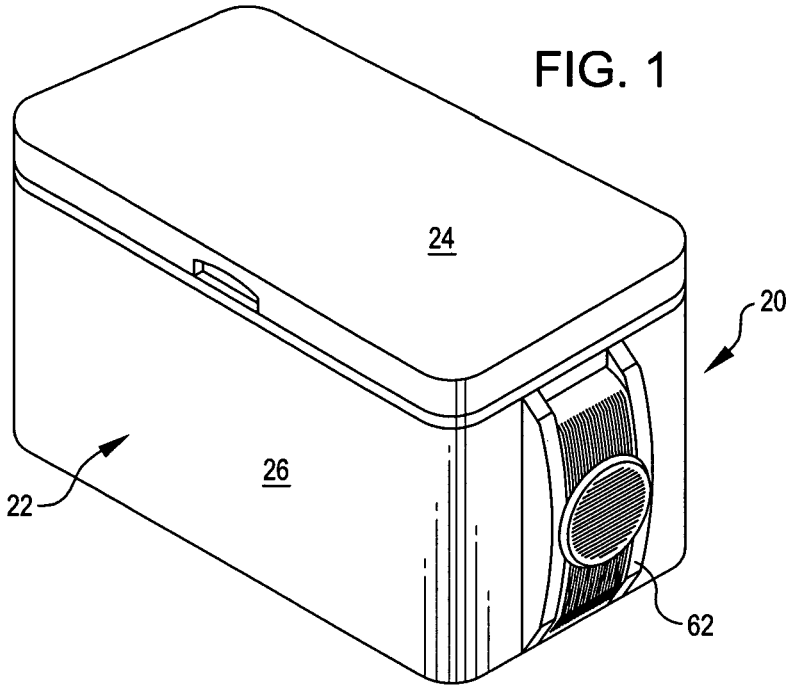
FIG. 1 is a side perspective view of an thermoelectric insulated container incorporating an embodiment of the present invention.

Referring now to the drawings, in which like reference numerals represent like parts throughout the several views, FIG. 1 shows a thermoelectric insulated container 20 incorporating an embodiment of the present invention. The thermoelectric insulated container 20 includes an insulated container 22 having a top 24, sides 26, and a bottom (not shown in the drawing). The insulated container 22 shown in the drawings is shaped like a conventional chest cooler, but other configurations may be used, such as an upright conventional refrigerator type of configuration, or a unit configured to operate in both chest and upright positions.

The insulated container 22 may include insulation. The insulation may be formed, for example, of polyurethane, polystyrene, polypropylene, ABS, polyethylene, vacuum panels, or other suitable insulating materials. The insulation preferably has sufficient thermal insulating qualities so that an insignificant amount of heat is lost though the sides 26 and top 24 of the insulated container 22. The top 24 in the embodiment shown serves as a lid and is preferably well-fitted, and may be sealed with a lid seal and a latch such as is known in the art, or with a suitable magnetic lid gasket. Such a structure minimizes heat loss that otherwise might occur through the closure for the lid.

Figure 2:
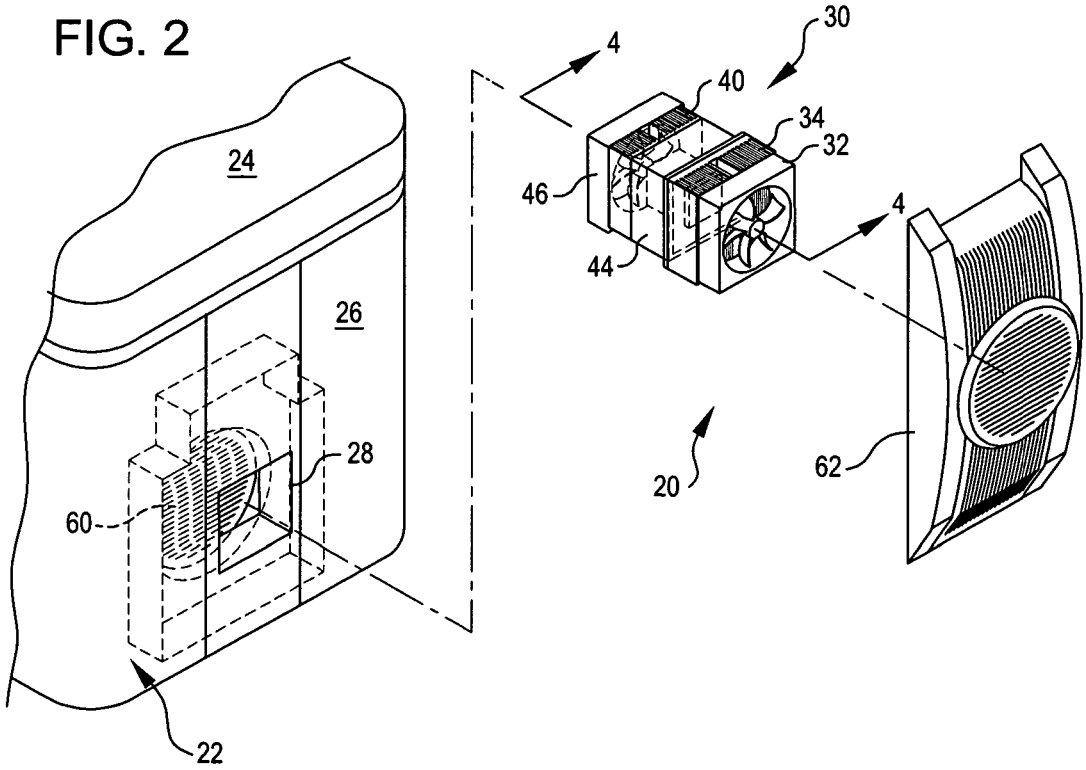
FIG. 2 is an exploded side perspective view of the thermoelectric insulated container of FIG. 1.

In accordance with an embodiment, a hole 28 (FIG. 2) is provided through the insulated container 22. The hole 28 is shown in one of the sides 26 of the insulated container 22, but may otherwise be situated in the top 24, the bottom, or at any juncture of these surfaces.

In accordance with an embodiment, a thermoelectric unit 30 (FIG. 2) is provided that fits into the hole 28 of the insulated container 22. Briefly described, the thermoelectric unit 30 is configured so as to minimize the size of the hole 28 while maximizing the efficiency of the thermoelectric cooler. In accordance with an embodiment, many of the components for the thermoelectric unit 30 are aligned linearly so that they may easily extend through the hole 28 without having to enlarge the hole 28.

Figure 3:
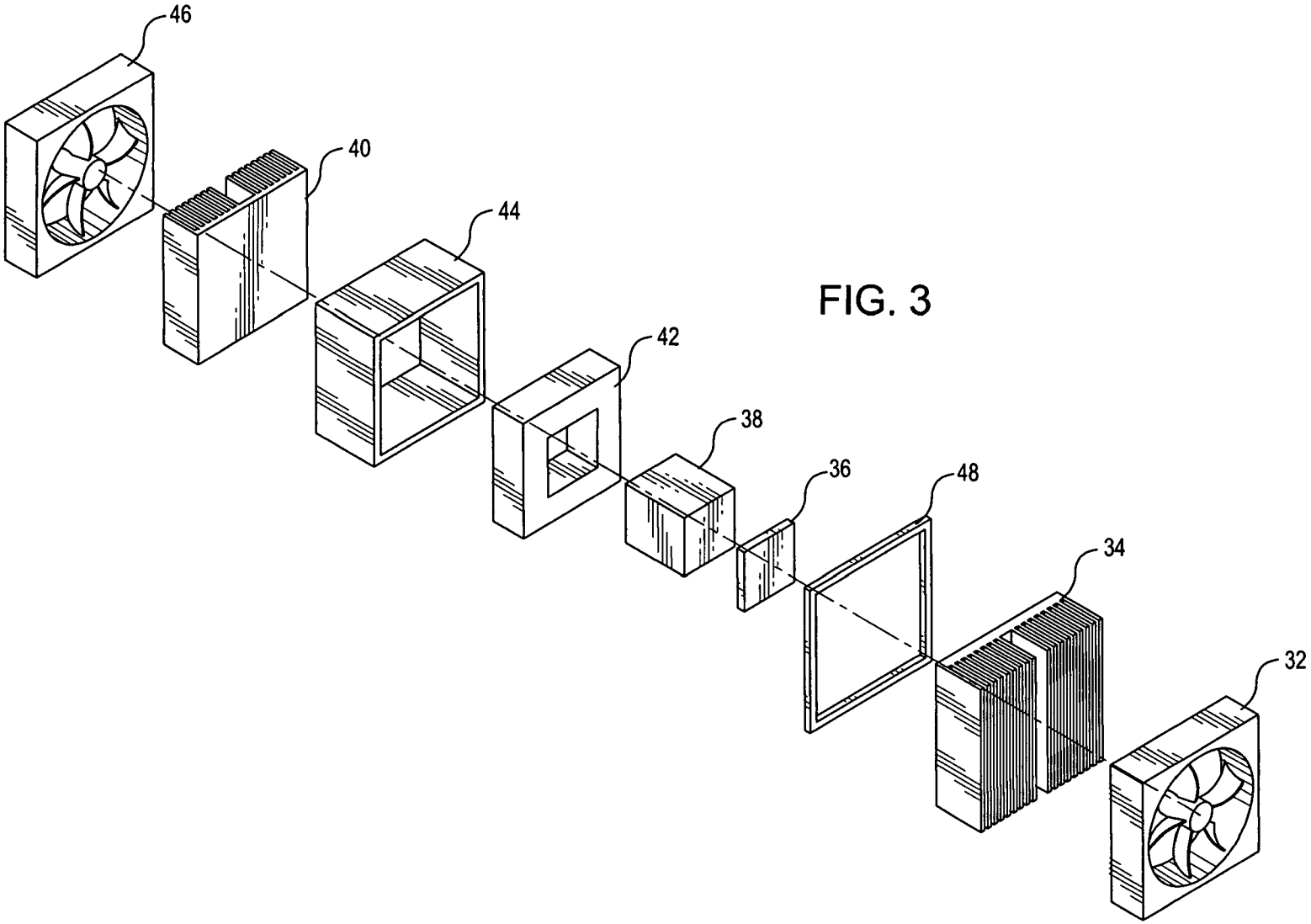
FIG. 3 is an exploded view of a thermoelectric unit for the thermoelectric insulated container of FIG. 1.

In the embodiment shown in the drawings, as can best be seen in FIG. 3, the thermoelectric unit 30 includes a hot side fan and motor unit 32 mounted on a hot side heat sink 34. The hot side heat sink 34 is attached to a thermoelectric module 36 and is arranged and configured to dissipate heat from the thermoelectric module 36. Thermoelectric modules, such as the thermoelectric module 36, are known, but in general are configured to act as a solid state heat pump.

As is known in the art, a heat sink such as the hot side heat sink 34 increases the surface area that is available for dissipating heat in a structure. The thermoelectric module 36 has a small surface area. The hot side heat sink 34 is larger than the thermoelectric module 36, and includes heat fins that increase the surface area of material that is thermally connected to the thermoelectric module 36 so that heat dissipation is more effective. The hot side fan 32 directs air over the heat fins, further aiding in dissipation of heat.

A thermally conductive block 38 is attached at an opposite side of the thermoelectric module 36. The thermally conductive block 38 is connected at an opposite end to a cold side heat sink 40. The thermally conductive block 38 is utilized to transfer heat between the thermoelectric module 36 and the cold side heat sink 40. In an embodiment, the thermally conductive block 38 is formed of aluminum, but another thermally conductive material may be used. The cold side heat sink 40 is used in a similar manner to that of the hot side heat sink 34, but instead helps to absorb heat (cool) instead of dissipate heat. If desired, the conductive block 38 may alternatively be mounted between the hot side heat sink 34 and the thermoelectric module 36, or two conductive blocks may be provided that extend between the respective heat sinks and the thermoelectric module 36.

The thermally conductive block 38 is preferably sized so that the hot side heat sink 34 may be positioned on the outside of the insulated container 22 when the thermoelectric insulated container 20 is assembled, with the cold side heat sink 40 on the inside of the insulated container 22. Thus, the thermally conductive block 38 may be, for example, a thickness of the insulation and liner materials for the insulated container 22 at the hole 28.

In accordance with an embodiment, insulation 42, such as polyurethane, is installed around the thermally conductive block 38 and the thermoelectric module 36. The insulation 42 may be blown into place around the thermally conductive block 38 and the thermoelectric module 36 or may otherwise be suitably attached to or extend around the thermally conductive block 38 and the thermoelectric module 36. In accordance with an embodiment, thermal tape 44 extends around the insulation 42. More or less thermal tape 44 may be provided so as to ensure close contact between the thermal tape 44 and the internal sides of the hole 28 and to minimize heat leakage.

In accordance with an embodiment, a cold side fan and motor unit 46 is mounted on the cold side heat sink 40. This cold side fan and motor unit 46 is preferably positioned within the interior of the insulated container 22 when the thermoelectric insulated container 20 is fully assembled.

A self adhesive sealing material 48 or other suitable sealing structure may be provided on an outer portion of a back side of the hot side heat sink 34. In accordance with an embodiment, the self adhesive sealing material 48 aligns with the portion of side walls 26 of the insulated container 22 immediately surrounding the hole 28. Thus, the self adhesive sealing material 48 further ensures minimal heat or cooling loss.

Figure 4:
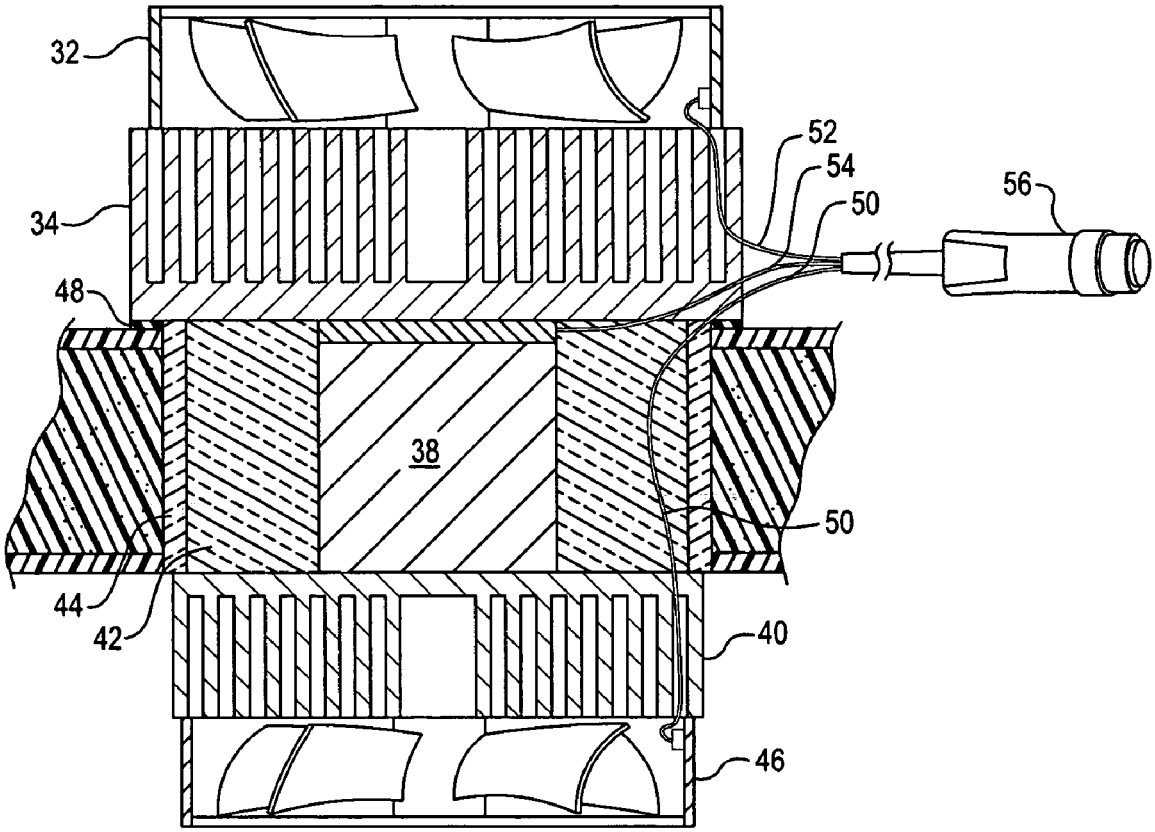
FIG. 4 is a sectional view taken along the section lines 4-4 in FIG. 2.

The cold side fan and motor unit 46 includes cold side fan wires 50 (FIG. 4). Similarly, the hot side fan and motor unit 32 includes hot side fan wires 52. The thermoelectric module 36 also includes wires 54. Each of these wires 50, 52, 54 may be routed to a common location so that the wires 50, 52, 54 may be attached to a plug 56. For example, as shown in FIG. 4, the cold side fan wires 50 and the wires 54 for the thermoelectric module 36 may be routed through the insulation 42 and through the hot side heat sink 34. The hot side fan wires 52 are routed through the hot side heat sink 34 to this same location. In this embodiment, the plug 56 is arranged so that it may be accessible from the outside of the insulated container 22 when the thermoelectric insulated container 20 is assembled. Routing the wires 50, 52, 54 so that they come out of the hot side heat sink 34 and then extend to the plug 56 permits the thermoelectric unit 30 to be installed with the wires 50, 52, and 54 to be accessible outside of the insulated container 22 when the thermoelectric unit is installed in the hole 28. In this manner, a separate notch or other structure around the hole 28 is not needed for routing of the wires 50, 52, and 54.

As an alternative to the arrangement shown in the drawings, the cold side fan wires 50 may extend through the cold side heat sink 40, through the insulation 42, and to a point adjacent to the hot side heat sink 34. The wires 54 for the thermoelectric module 36 may join the cold side fan wires 50 at this location, and the hot side fan wires 52 may be routed, for example, through the hot side heat sink 34 to join the wires in this location. When fully assembled in the thermoelectric insulated container 20, the thermoelectric unit 30 may be positioned so that the wires 50, 52, 54 extend out of a notch (not shown) in the hole 28. This arrangement is not as convenient as the arrangement shown in the drawing, which does not require a notch.

The thermoelectric unit 30 may also include one or more of the following: electrical connectors for the hot and cold side fan and motor units 32, 46 and the thermoelectric module 36, thermal switches, holders for the thermoelectric module and thermal switches, and fasteners for joining components.

To assemble the thermoelectric insulated container 20, a manufacturer makes or obtains a thermoelectric unit 30. Because the thermoelectric unit 30 is compact, it may be manufactured at a remote location and shipped to the manufacturer doing the assembly. For example, the assembly manufacturer may be a manufacturer of insulated containers, such as the insulated container 22, and may assemble the thermoelectric unit 30 with an insulated container such as the insulated container 22.

The thermoelectric unit 30 is compact in configuration, and thus shipping charges for shipping the thermoelectric unit 30 are minimized. The linear alignment of the thermoelectric module 36 and the hot side heat sink 34 and the cold side heat sink 40 provides a compact, low volume configuration, which also minimizes shipping costs. In addition, the hot side fan and motor unit 32 and cold side fan and motor unit 46 are similarly linearly arranged with the thermoelectric module 36, further reducing volume. The components of the thermoelectric unit may be arranged in a manner other than linearly, but arranging the components in a different manner may increase the associated freight costs and decrease the efficiency of the thermoelectric insulated cooler.

The thermoelectric unit 30 is fully assembled when received by the assembling manufacturer, and only needs to be inserted into and attached to the insulated container 22 to complete assembly of the thermoelectric insulated container 20. To this end, the thermoelectric unit 30 is installed into the hole 28, as is further described below.

To install the thermoelectric unit 30, the cold side heat sink 40 and cold side fan and motor unit 46 side of the thermoelectric unit 30 is inserted from the outside of the insulated container 22 into the hole 28. Assembly is performed in this manner because typically the cold side heat sink 40 is of a smaller size than the hot side heat sink 34, although other arrangements may be provided. For example, the thermoelectric unit 30 may alternatively be installed from the inside and pressed out of the hole 28.

When installed in the thermoelectric unit 30, the assembling manufacturer may add or remove thermal tape 44 from around the insulation 42 to ensure that the thermoelectric unit 30 fits tightly within the hole 28, thus minimizing heat loss. This feature also allows for manufacturing tolerances of the thermoelectric unit 30 and/or the hole 28 in the insulated container 22.

In accordance with an embodiment, when the thermoelectric unit 30 is installed in the hole 28, the cold side heat sink 40 extends into an interior of the insulated container 22. The cold side fan 46 also extends into the interior. This feature maximizes heat transfer between the thermoelectric unit 30 and the interior of the insulated container 22, therefore maximizing cooling.

A cold side fan cover 60 (FIG. 2) may be situated over the cold side fan and motor unit 46 and the cold side heat sink 40. The structure of the cold side fan cover 60 is variable, but preferably includes vents for permitting airflow.

A hot side fan cover 62 (FIGS. 1 and 2) may be provided for mounting over the hot side fan and motor unit 32 and the hot side heat sink 34 on the outside of the insulated container 22. If desired, the hot side fan cover 62 may include a receptacle for receiving the plug 56.

In accordance with an embodiment, one or both of the cold side fan cover 60 and the hot side fan cover 62 may be preassembled with the thermoelectric unit 30 and shipped along with the thermoelectric unit to an assembling manufacturer. Preassembling one or both of the fan covers 60 and 62 with the thermoelectric unit 30 allows the fan covers 60 and 62 to be attached to the rest of components of the thermoelectric unit 30 in a low-cost labor area prior to the final assembly, which can further reduce the labor required during final assembly of the thermoelectric insulated container 20.

If the cold side fan cover 60 is attached to the thermoelectric unit 30 prior to final assembly, in accordance with an embodiment, the cold side fan cover is sized so that it may fit through the hole 28. The hot side fan cover 62, however, may be larger than the hole 28 because it does not have to pass through the hole in the described embodiment.

To use the thermoelectric insulated container 20, power is supplied to the plug 56, for example by a cigarette lighter adapter or a DC power source. The power source may attach to the plug 56 in a manner known in the art. In cooling operation, power is supplied to the thermoelectric unit 30, which draws heat from the insulated container 22, providing cooling within the insulated container. In heating operation, power is supplied to the thermoelectric unit 30, which pumps heat into the insulated container 22, providing heating within the insulated container.

The thermoelectric unit 30, because of its compact size and linearly-arranged components, may be mounted in a hole 28 of minimal size in an insulated container, such as the insulated container 22. As such, heat loss from the insulated container 22 is minimized. A single opening, i.e., the hole 28, receives the cold side fan 46 and the cold side heat sink 40 during installation. In addition, the insulation 42 minimizes heat loss through the hole 28. If desired, for the embodiment shown in the drawings, the components of the thermoelectric unit 30 arranged outside of the insulated container 22 (i.e., the hot side fan and motor unit 32 and the hot side heat sink 34 may be arranged in a manner other than linearly, because these items do not have to be inserted through the hole 28. In addition, other arrangements of the components are possible. As an example, a single motor may drive both fans, utilizing a shaft that extends through the central components of the thermoelectric unit 30.

The thermoelectric unit 30 also does not require further assembly when installed in the insulated container 22. This feature minimizes labor in assembling the thermoelectric insulated container 20.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A thermoelectric insulated container, comprising:

an insulated container having a hole therethrough, the hole defining a depth and an inner periphery; and a thermoelectric unit extending into the insulated container, the thermoelectric unit comprising:

a thermoelectric module;

a thermally conductive block connected to the thermoelectric module;

a first heat sink connected to one of the thermally conductive block and the thermoelectric module and positioned in fluid communication with an inside of the insulated container;

a first fan positioned to direct air over the first heat sink; and a second heat sink connected to the other of the thermally conductive block and the thermoelectric module and in fluid communication with an outside of the insulated container;

the first heat sink, the thermoelectric module, and the second heat sink being aligned linearly such that a line projecting through the first heat sink, the thermoelectric module, and the second heat sink extends through the hole;

the thermally conductive block and the thermoelectric module being arranged and configured such that the first and second heat sinks are spaced a distance substantially the same as the depth, whereby the second heat sink is mostly outside of the insulated container, and the first heat sink is mostly inside the insulated container.

2. The thermoelectric insulated container of claim 1, wherein the first fan is also aligned linearly with the first heat sink, the thermoelectric module, and the second heat sink being such that a line projecting through the first fan, the first heat sink, the thermoelectric module, and the second heat sink extends through the hole.

3. The thermoelectric insulated container of claim 2, wherein the thermoelectric unit further comprises a second fan positioned to direct air over the second heat sink, the second fan aligned linearly with the first fan, the first heat sink, the thermoelectric module, the second fan, and the second heat sink being such that a line projecting through the first fan, the first heat sink, the thermoelectric module, the second fan, and the second heat sink extends through the hole.

4. The thermoelectric insulated container of claim 3, wherein the first fan comprises a first motor, and the second fan comprises a second motor, and further comprising a wiring harness with wires extending from the first motor, the second motor, and the thermoelectric module, with the wires extending out of the second heat sink at a position outside the insulated container.

5. The thermoelectric insulated container of claim 1, wherein an outer periphery of the thermally conductive block is substantially smaller than the inner periphery of the hole, and further comprising insulation around the thermally conductive block, the insulation extending between the first and second heat sinks and having a outer profile that substantially matches the inner periphery of the hole.

6. The thermoelectric insulated container of claim 5, wherein the first heat sink has a outer periphery that is slightly less than the inner periphery of the hole.

7. The thermoelectric insulated container of claim 6, wherein an outer profile of the combined insulation and the thermally conductive block substantially matches the inner periphery of the hole.

8. The thermoelectric insulated container of claim 5, wherein an outer profile of the combined insulation and the thermally conductive block substantially matches the inner periphery of the hole.

9. The thermoelectric insulated container of claim 1, wherein the first heat sink has a outer profile that is slightly less than the outer periphery of the hole.

10. The thermoelectric unit of the thermoelectric insulated container of claim 1.

11. The thermoelectric insulated container of claim 1, wherein the first fan comprises a first motor, and further comprising a wiring harness with wires extending from the first motor and the thermoelectric module, with the wires extending out of the second heat sink at a position outside the insulated container.

* * * * *